US009835998B2

(12) United States Patent
Mizutani et al.

(10) Patent No.: US 9,835,998 B2
(45) Date of Patent: Dec. 5, 2017

(54) SHEET PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Kikuo Mizutani, Izu Shizuoka (JP); Ken Iguchi, Numazu Shizuoka (JP); Isao Yahata, Izunokuni Shizuoka (JP); Hiroyuki Sugiyama, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/006,336

(22) Filed: Jan. 26, 2016

(65) Prior Publication Data

US 2017/0212460 A1 Jul. 27, 2017

(51) Int. Cl.

| | |
|---|---|
| ***G03G 15/20*** | (2006.01) |
| ***B65H 1/04*** | (2006.01) |
| ***B65H 3/36*** | (2006.01) |
| ***B65H 5/06*** | (2006.01) |
| ***B65H 29/12*** | (2006.01) |
| ***B65H 31/14*** | (2006.01) |
| ***B65H 9/00*** | (2006.01) |

(52) U.S. Cl.

CPC ..... *G03G 15/2085* (2013.01); *B65H 1/04* (2013.01); *B65H 3/36* (2013.01); *B65H 5/062* (2013.01); *B65H 9/002* (2013.01); *B65H 29/12* (2013.01); *B65H 31/14* (2013.01); *B65H 2801/03* (2013.01)

(58) Field of Classification Search

CPC . B65H 1/04; B65H 3/36; B65H 29/12; B65H 31/14; B65H 9/002; B65H 5/062; B65H 2801/03; G03G 15/2085

USPC ..... 271/3.01, 3.02, 3.03

See application file for complete search history.

(56) References Cited

U.S. PATENT DOCUMENTS

| | | | | |
|---|---|---|---|---|
| 5,040,784 | A * | 8/1991 | Akashi | B65H 29/52 271/220 |
| 8,292,287 | B2 | 10/2012 | Iguchi et al. | |
| 8,830,284 | B2 | 9/2014 | Tsuchihashi et al. | |
| 9,126,786 | B2 | 9/2015 | Taki | |
| 2016/0136987 | A1 | 5/2016 | Yahata et al. | |

* cited by examiner

*Primary Examiner* — David H Bollinger

(74) *Attorney, Agent, or Firm* — Amin, Turocy & Watson LLP

(57) ABSTRACT

In accordance with an embodiment, a sheet processing apparatus comprises a decoloring section, a stacking section, an image forming section, a sheet feed roller and a combined roller. The decoloring section carries out a decoloring processing on a sheet. The sheet subjected to the decoloring processing is discharged to the stacking section. The image forming section carries out an image forming processing on the sheet fed from the stacking section. The sheet feed roller feeds a sheet stacked in the stacking section to a conveyance path through which the sheet is fed to the image forming section. The combined roller aligns the sheets to be discharged to the stacking section at a reference position in a conveyance direction in which the sheets are conveyed to the sheet feed roller, and feeds the sheets stacked in the stacking section to the sheet feed roller along the conveyance direction.

8 Claims, 13 Drawing Sheets

SHEET PROCESSING APPARATUS

FIELD

Embodiments described herein relate generally to a technology of aligning sheets and a technology of picking up the sheets.

BACKGROUND

There is a sheet processing apparatus which can execute both a decoloring processing and an image forming processing. In the sheet processing apparatus, it is considered that a cassette is used as not only a sheet discharge cassette for stacking the discharged sheet subjected to the decoloring processing, but also a sheet feed cassette for feeding the sheet to be subjected to the image forming processing.

In this case, it is required to equip with a pickup mechanism in the sheet processing apparatus to pick up sheets from the cassette. Further, in order to ensure the accuracy when performing the image forming processing on the sheet, it is required to equip with an alignment mechanism to align the sheets to be discharged to the cassette.

Thus, when the cassette is used as both the sheet discharge cassette and the sheet feed cassette in the sheet processing apparatus, there is a problem that the sheet processing apparatus becomes large-sized because it is required to equip with the alignment mechanism in addition to the pickup mechanism.

DETAILED DESCRIPTION

In accordance with an embodiment, a sheet processing apparatus comprises a decoloring section, a stacking section, an image forming section, a sheet feed roller and a combined roller. The decoloring section carries out a decoloring processing on a sheet. The sheet subjected to the decoloring processing is discharged to the stacking section. The image forming section carries out an image forming processing on the sheet fed from the stacking section. The sheet feed roller feeds a sheet stacked in the stacking section to a conveyance path through which the sheet is fed to the image forming section. The combined roller aligns the sheets to be discharged to the stacking section at a reference position in a conveyance direction in which the sheets are conveyed to the sheet feed roller, and feeds the sheets stacked in the stacking section to the sheet feed roller along the conveyance direction.

Hereinafter, embodiments are described with reference to the accompanying drawings.

(A First Embodiment)

(Whole Constitution)

Figure 1:
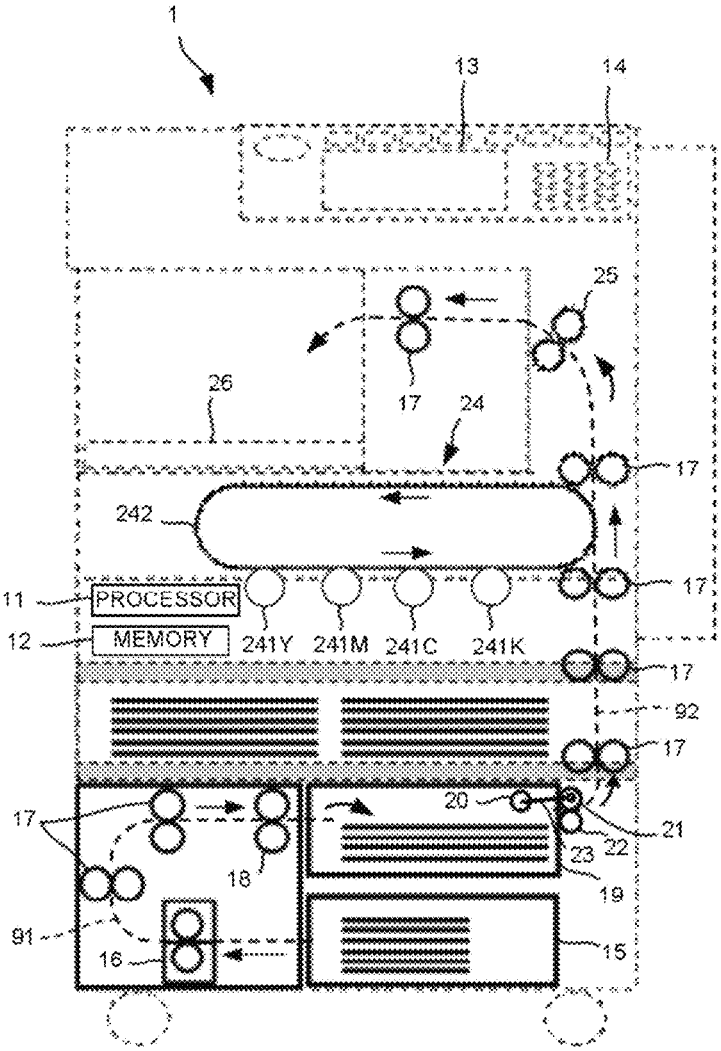
FIG. 1 is a diagram illustrating an image forming apparatus.

FIG. 1 is a diagram illustrating an image forming apparatus 1 (sheet processing apparatus).

The image forming apparatus 1 can execute a decoloring processing for decoloring an image on a sheet to enable the sheet to be reusable and an image forming processing for forming an image on a sheet.

The image forming apparatus 1 comprises a processor 11, a memory 12, a display section 13 and an input section 14.

The processor 11 reads programs in the memory 12 to carry out various processing of the image forming apparatus 1. The display section 13 displays setting information and operation status of the image forming apparatus 1, log information and notifications for a user. The input section 14, which is equipped with buttons and keys, receives input operations by the user.

The image forming apparatus 1 comprises a first cassette 15, a decoloring section 16, conveyance rollers 17, a sheet discharge roller 18, a second cassette 19 (stacking section), a combined roller 20, a sheet feed roller 21, a separation roller 22, a moving mechanism 23, an image forming section 24, a fixing device 25 and a sheet discharge stack 26.

The first cassette 15 is located at the lower part of the image forming apparatus 1. The first cassette 15 stacks sheets on which images are formed with decolorable color material. The decolorable color material includes a color generation compound, a developer and a decoloring agent. For example, the leuco dye which generates blue color is exemplified as the color generation compound. For example, the phenols is exemplified as the developer. A substance which is compatible with the color generation compound when being heated, and has no affinity with the developer is exemplified as the decoloring agent. The decolorable color material generates a color through an interaction between the color generation compound and the developer, and is decolored when the interaction between the color generation compound and the developer is eliminated if being heated to a temperature higher than the decoloring temperature. The decolorable color material may be decolorable toner or decolorable ink. In the present embodiment, it is assumed that the image on the sheet is formed with the decolorable toner.

The decoloring section 16 is arranged at the lower part of the image forming apparatus 1 and is adjacent to the first cassette 15. The decoloring section 16 is equipped with a heat roller which is contacted with one side and the other side of the sheet. The decoloring section 16 heats one side and/or the other side of the sheet through the heat roller to decolor the images on the sheet.

Further, the "decoloring" in the present embodiment refers to making an image formed with a color (including not only chromatic color but also achromatic color such as white and black) different from the ground color of a sheet invisible or hardly visible. Herein, "make an image invisible" may refer to changing the color of the image formed in a color different from the ground color of sheet to be same as or similar to the ground color of sheet, in addition to making the image formed in a color different from the ground color of sheet colorless (transparent).

The conveyance roller 17 includes a pair of rollers facing to each other to convey sheets to the downstream side in the conveyance direction. Further, in the following description, there is a case in which only "downstream side" is recorded, and it means "the downstream side in the sheet conveyance direction" in this case. Further, in a case of recording "downstream", it also means "the downstream in the sheet conveyance direction". Similarly, it is also applicable to the cases in which "upstream" and "upstream side" are recorded.

The sheet discharge roller 18 is located at the upstream side of the second cassette 19 and at one end in the horizontal direction in FIG. 1. The sheet discharge roller 18 includes a pair of rollers facing to each other to discharge the sheet to the second cassette 19.

For example, a light transmission type sheet sensor 181 (FIG. 2) which detects that the sheet passes through the sheet discharge roller 18 is arranged at the upstream side of the sheet discharge roller 18. The sheet sensor 181 may be arranged at the downstream side of the sheet discharge roller 18.

The second cassette 19 is arranged above the first cassette 15. The second cassette 19 stacks the sheets subjected to decoloring processing. By drawing first cassette 15 and the second cassette 19 from the image forming apparatus 1 in a direction perpendicular to paper in the FIG. 1, the user can put sheets into the first cassette 15 and the second cassette 19, and can take out sheets from the first cassette 15 and the second cassette 19.

A conveyance path 91 starts from the first cassette 15 to the second cassette 19. On the conveyance path 91, there are the decoloring section 16, the conveyance roller and the sheet discharge roller 18. In FIG. 1, the conveyance path 91 extends from the first cassette 15 to left side, turns upward and right sequentially, and finally to the second cassette 19.

A conveyance path 92 is arranged to convey the sheet from the second cassette 19 to the image forming section 24. In FIG. 1, the conveyance path 92 extends from the sheet feed roller 21 to the right side, turns upward and then extends upward. Along the conveyance path 92, the sheet feed roller 21, the separation roller 22, the conveyance roller 17, the image forming section 24 and the fixing device 25 are arranged.

The sheet feed roller 21 faces the separation roller 22. The sheet feed roller 21 and the separation roller 22 feed the sheets inside the second cassette 19 one by one on the conveyance path 92.

The separation roller 22 presses against the sheet feed roller 21. A torque in a rotation direction (the anticlockwise direction in FIG. 1) in which the sheet is conveyed in a returning direction reverse to the conveyance direction is transmitted to the separation roller 22. In a case in which one sheet enters a space between the sheet feed roller 21 and the separation roller 22, the separation roller 22 rotates along with the rotation of the sheet feed roller 21. In a case in which two or more than two sheets enter the space between the sheet feed roller 21 and the separation roller 22, the conveyance of the sheet at the lowermost is stopped by the separation roller 22. Only the one sheet at the uppermost is sequentially conveyed to the downstream side in the sheet conveyance direction by the sheet feed roller 21.

The conveyance roller 17 conveys the sheet conveyed to the conveyance path 92 by the sheet feed roller 21 to the image forming section 24.

The image forming section 24 forms images with toner of four colors (Y, M, C and K) on photoconductive drums 241Y, 241M, 241C and 241K respectively for aforementioned four colors through a laser optical system. The image forming section 24 overlaps the images on the photoconductive drums 241Y, 241M, 241C and 241K on a transfer belt 242 to form one color image. The image forming section 24 transfers the color image on the transfer belt 242 to the sheet.

The image forming section 24 may be a mechanism which transfers the images from the photoconductive drums to the sheet directly without using the transfer belt 242. The image forming section 24 may form an image on the sheet with the decolorable toner. The image forming section may form an image on the sheet with ink or decolorable ink through an inkjet head. The image forming section 24 may be capable of transferring only monochrome image to the sheet.

The fixing device 25 heats the sheet to fix the image that is on the sheet to the sheet. The sheet subjected to fixing processing by the fixing device 25 is discharged to the sheet discharge stack 26.

(Alignment Operations and Pickup Operations of Sheets)

Figure 2:
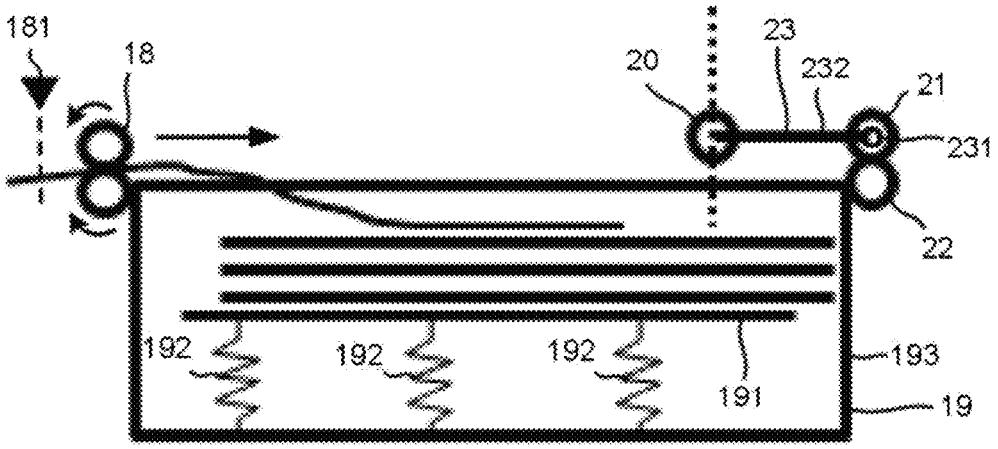
FIG. 2 is a diagram illustrating a second cassette, a moving mechanism and a combined roller.

FIG. 2 is a diagram illustrating the second cassette 19, the moving mechanism 23 and the combined roller 20.

There is a plate-shaped sheet tray 191 in the second cassette 19. The sheet tray 191 stacks sheets discharged to the second cassette 19. The A4-sized sheets or letter-sized sheets are stored in a manner that the short-side direction is along the conveyance direction in the first cassette 15 and the second cassette 19.

When the second cassette 19 is arranged inside the image forming apparatus 1, the sheet tray 191 is maintained in a horizontal state by springs 192. When the second cassette 19 is arranged inside the image forming apparatus 1, the sheet tray 191 may be arranged in such a manner that the end at the upstream side (the side of the sheet discharge roller 18) is inclined downward towards the other end at the downstream side (the side of the sheet feed roller 21), or arranged in such a manner that the end at the upstream side (the side of the sheet discharge roller 18) is inclined upward towards the other end at the downstream side (the side of the sheet feed roller 21).

The moving mechanism 23 enables a link 232 to rotate around a rotary shaft 231 located at the upstream side (the side of the sheet feed roller 21). In this way, the moving mechanism 23 enables the combined roller 20 at the front end of the link 232 to ascend and descend between a home position in FIG. 2 and an alignment position (sheet feed position) in FIG. 3.

The home position of the combined roller 20 is a position where the combined roller 20 is separated from and above the sheets stacked in the second cassette 19. The alignment position is a position (a contactable position with sheet) where the combined roller 20 is abutted against the sheets stacked in the second cassette 19. The alignment position is closer to the sheet feed roller 21 than the sheet discharge roller 18 in the sheet conveyance direction towards the sheet feed roller 21.

A torque in a direction in which the combined roller 20 is rotated in the conveyance direction in which the sheet is send to the downstream side is transmitted to the combined roller 20. For example, such a torque is transmitted from the sheet feed roller 21 to the combined roller 20 via a gear or belt.

Figure 4:
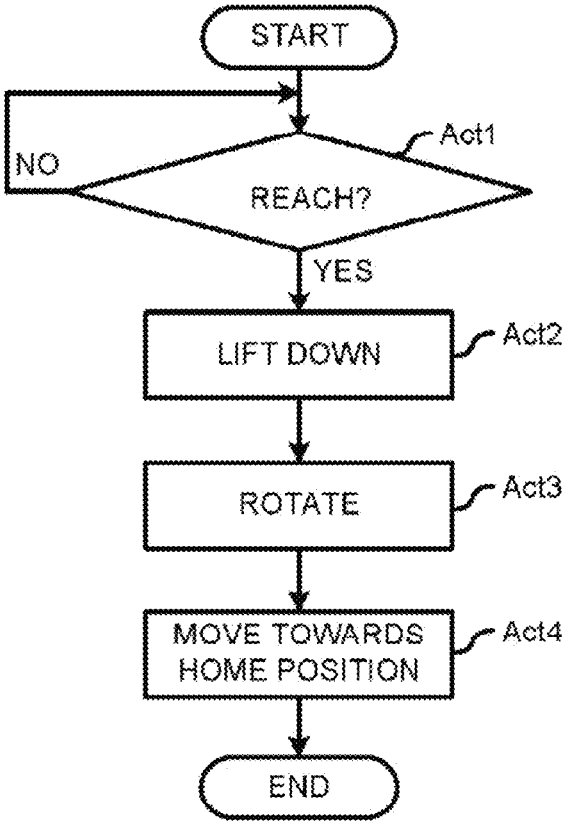
FIG. 4 is a flowchart illustrating an alignment processing at the time of a decoloring processing.

Hereinafter, an alignment processing at the time of decoloring processing is described with reference to the flowchart in FIG. 4.

If receiving an instruction to carry out a decoloring processing, the processor 11 takes out a sheet from the first cassette 15, and heats the sheet through the decoloring section 16 to decolor an image on the sheet.

As shown in FIG. 2, the processor 11 discharges the sheet subjected to the decoloring processing to the second cassette 19 with the sheet discharge roller 18.

The processor 11 detects that the downstream end (front end) in the conveyance direction of the sheet reaches the alignment position directly under the combined roller 20 (YES in ACT 1).

Specifically, when the sheet discharge roller 18 is driven to rotate at a given amount (a given number of pulses) after the downstream end of sheet is detected by the sheet sensor 181, or when the sheet discharge roller 18 is driven to rotate at a given amount after the upstream end of the sheet passes through the sheet sensor 181, the processor 11 detects that the downstream end in the conveyance direction of the sheet reaches the alignment position directly under the combined roller 20.

Figure 3:
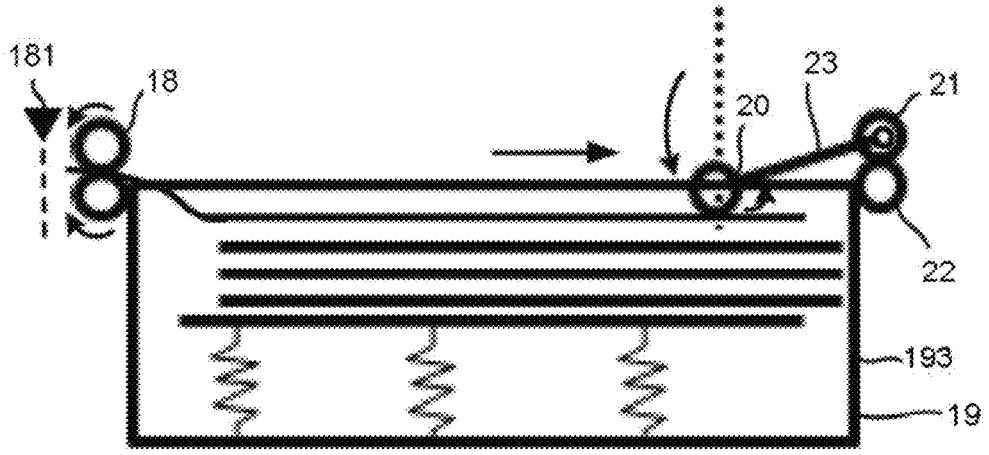
FIG. 3 is a diagram illustrating an alignment position.

As shown in FIG. 3, the processor 11 enables the combined roller 20 at the home position to descend to the alignment position through the moving mechanism 23 in such a manner that the combined roller 20 presses against the sheets. (ACT 2)

The processor 11 enables the combined roller 20 to rotate to send the sheet to the downstream side until the downstream end of the sheet abuts against a wall portion 193 at the downstream end of the second cassette 19 (ACT 3). In this way, the sheet is aligned at the reference position where the downstream end of the sheet is contacted with the wall portion 193 in the conveyance direction.

It is assumed that when the combined roller 20 is contacted with the sheet, the upstream end of the sheet is clamped by the sheet discharge roller 18, and it may also be not clamped. The processor 11 may enable the combined roller 20 to descend while rotating it to abut against the sheet, or may enable the combined roller 20 to rotate after the combined roller 20 abuts against the sheet.

The processor 11 enables the combined roller 20 to ascend through the moving mechanism 23 to locate at the home position (ACT 4).

Figure 5:
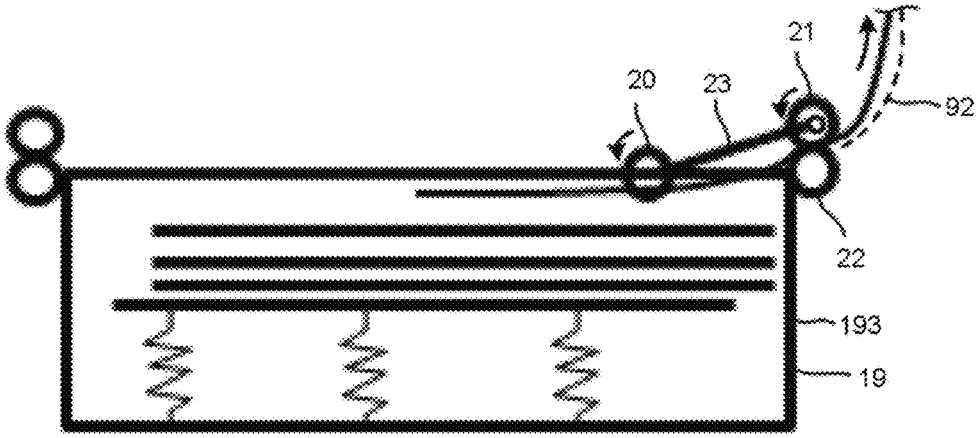
FIG. 5 is a diagram illustrating a sheet feed processing.

FIG. 5 is a diagram illustrating a sheet feed processing.

If receiving an instruction to carry out an image forming processing, the processor 11 enables the combined roller 20 at the home position to descend to the alignment position (sheet feed position) through the moving mechanism 23.

The processor 11 enables the combined roller 20 to rotate to feed a sheet in the second cassette 19 to the sheet feed roller 21. This sheet, which is subjected to the decoloring processing, is a reusable sheet. The processor 11 may enable the combined roller 20 to descend while rotating it to abut against the sheet, or may enable the combined roller 20 to rotate after the combined roller 20 abutted against the sheet.

The processor 11 enables the sheet feed roller 21 to rotate to feed the sheet to the conveyance path 92.

After an image is formed by the image forming section 24 on the sheet, the processor 11 enables the fixing device 25 to fix the image on the sheet.

The processor 11 discharges the sheet to the sheet discharge stack 26.

In the present embodiment, a pickup mechanism (including the components 11, 12 and 20~23) which carries out the sheet feed processing at the time of the image forming processing is also used as an alignment mechanism which carries out the sheet alignment processing after the decoloring processing is carried out. Thus, it is possible not to equip with an alignment mechanism dedicated for the alignment processing, which can miniaturize the apparatus in the present embodiment.

(A Second Embodiment)

Figure 6:
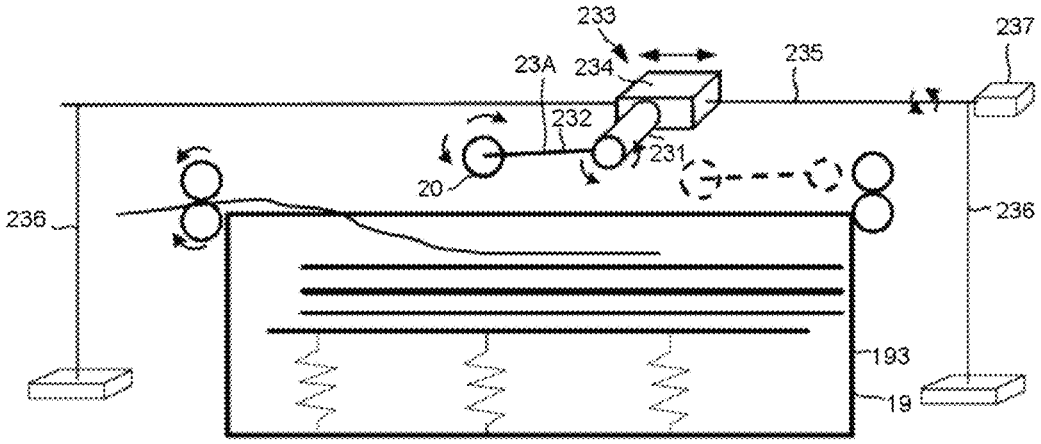
FIG. 6 is a diagram illustrating the moving mechanism.

FIG. 6 is a diagram illustrating a moving mechanism 23A.

The moving mechanism 23A moves the combined roller 20 along the conveyance direction, and positions the combined roller 20 at the alignment position when the sheets are aligned. When the sheet is fed by the sheet feed roller 21, the moving mechanism 23A positions the combined roller 20 at a paper feed position different from the alignment position.

The moving mechanism 23A includes the rotary shaft 231 and a conveyance direction moving mechanism 233 which moves the link 232 in the conveyance direction.

The conveyance direction moving mechanism 233 is provided with a nut 234, a screw shaft 235, holding sections 236 and a motor 237. The nut 234 supports and rotates the rotary shaft 231. The screw shaft 235 is inserted into the nut 234. The holding sections 236 hold the two ends in the longitudinal direction of the screw shaft 235 in a rotatable manner. The motor 237 is driven to rotate the screw shaft 235 to move the nut 234 in the conveyance direction.

As indicated by one-dotted lines in FIG. 6, the home position of the combined roller 20 is such a position from which the combined roller 20 can be positioned at the sheet feed position by only being lowered. That is, the home position of the combined roller 20 corresponds to the sheet feed position and is located above the sheet feed position.

The alignment position of the combined roller 20 refers to such a position where the upstream side of the sheet of which the downstream end of sheet is abutted against the wall portion 193 of the second cassette 19 is contacted with the combined roller 20.

Before a decoloring processing is started, the processor 11 acquires a sheet size in advance. By setting the sheet size in advance, or by receiving the setting on the sheet size through the input section 14, the processor 11 acquires the sheet size.

The processor 11 determines the alignment position based on the sheet size. In the present embodiment, the processor 11 determines the alignment position on the condition that the upstream side of sheet is clamped by the sheet discharge roller 18 when the combined roller 20 is in contact with the sheet. Thus, the processor 11 determines the alignment position to be at the upstream side when the sheet size gets small. When a curl is generated at the upstream end of sheet, the upstream end of the sheet may jam in the sheet discharge roller 18. In the case in which the upstream side of sheet is clamped by the sheet discharge roller 18 when the combined roller 20 is in contact with the sheet, the combined roller 20 can assist in conveying the sheet to the downstream side. Consequently, it is preferred that the upstream side of the sheet is clamped by the sheet discharge roller 18 when the combined roller 20 is in contact with the sheet.

Hereinafter, an alignment processing at the time of the decoloring processing is described with reference to the flowchart in FIG. 7.

If receiving an instruction to carry out a decoloring processing, the processor 11 picks up a sheet from the first cassette 15 to perform a decoloring processing on the sheet. The processor 11 determines an alignment position and a standby position corresponding to the alignment position based on a sheet size. The standby position corresponding to the alignment position refers to a position from which the combined roller 20 can be positioned at the alignment position by only being lowered. The processor 11 moves the combined roller 20 from the home position in FIG. 6 to the standby position along the conveyance direction (ACT 11).

The processor 11 discharges the sheet to the second cassette 19 through the sheet discharge roller 18, and detects that the downstream end of the sheet reaches the alignment position directly under the combined roller 20 (YES in ACT 12).

Figure 8:
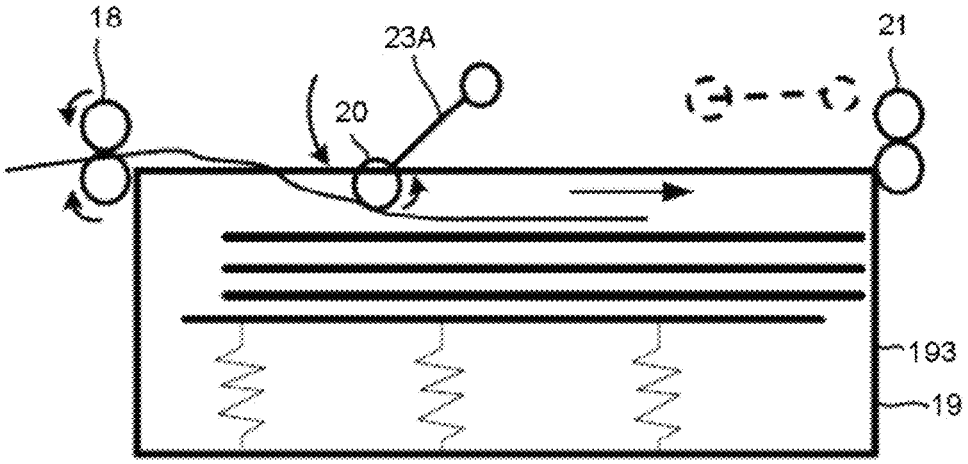
FIG. 8 is a diagram illustrating a combined roller located at the alignment position.

As shown in FIG. 8, the processor 11 enables the combined roller 20 at the standby position to descend with the moving mechanism 23 to the alignment position in such a manner that the combined roller 20 presses against the upstream side of sheet (ACT 13). It is assumed that when the combined roller 20 is in contact with the sheet, the upstream side of sheet is clamped by the sheet discharge roller 18, and it may also not be clamped by the sheet discharge roller 18. Further, the conveyance direction moving mechanism 233 is not shown in FIG. 8.

The processor 11 rotates the combined roller 20 to feed the sheet to the downstream side to make the downstream end of sheet abut against the wall portion 193 of the second cassette 19 (ACT 14). At this time, after the downstream side of sheet bends upward, the sheet stretches to the upstream side and is aligned in a state in which the downstream end of the sheet is abutted against the wall portion 193 of the second cassette 19.

Further, at this time, the processor 11 changes the feeding amount of sheet towards the conveyance direction by the combined roller 20 in response to the sheet size to align the sheet properly. The smaller (smaller than the predetermined size) the sheet size is, the longer the distance from the sheet when the combined roller 20 is being contacted with the sheet to the wall portion 193 is; the larger (larger than the predetermined size) the sheet size is, the shorter the distance from the sheet when the combined roller 20 is being contacted with the sheet to the wall portion 193 is. Thus, the processor 11 sets a larger sheet feeding amount if the sheet size is smaller than the predetermined size, and sets a smaller sheet feeding amount if the sheet size is larger than the predetermined size.

After the combined roller 20 is lifted up with the moving mechanism 23, the processor 11 positions the combined roller 20 at the home position (ACT 15).

In the present embodiment, since the alignment position is set to be at an appropriate position according to a sheet size, the sheet can be aligned properly and the sheet feed failure can also be suppressed.

Figure 9:
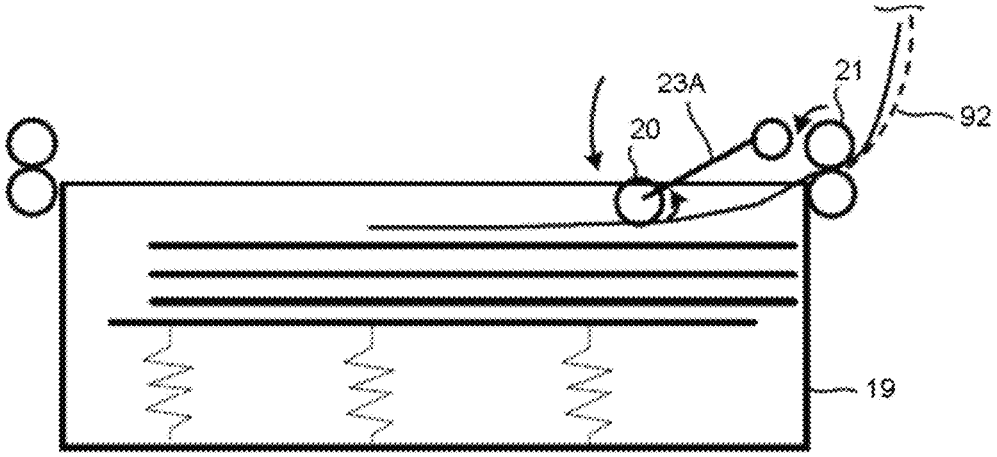
FIG. 9 is a diagram illustrating a sheet feed processing.

FIG. 9 is a diagram illustrating a sheet feed processing.

If receiving an instruction to carry out an image forming processing, the processor 11 enables the moving mechanism 23 to lift the combined roller 20 at the home position down to the sheet feed position.

The processor 11 rotates the combined roller 20 to feed a sheet in the second cassette 19 to the sheet feed roller 21. The processor 11 feeds the sheet to the conveyance path 92 with the sheet feed roller 21, and forms an image on the sheet with the image forming section 24.

As indicated by the one-dotted lines in FIG. 6, the home position of the combined roller 20 corresponds to the sheet feed position and is located above the sheet feed position in the present embodiment. Thus, the combined roller 20 can be positioned at the sheet feed position only by lowering it down from the home position in the present embodiment, and thus it is possible to shorten the processing time required to carry out the sheet feed processing.

(A Third Embodiment)

Figure 10:
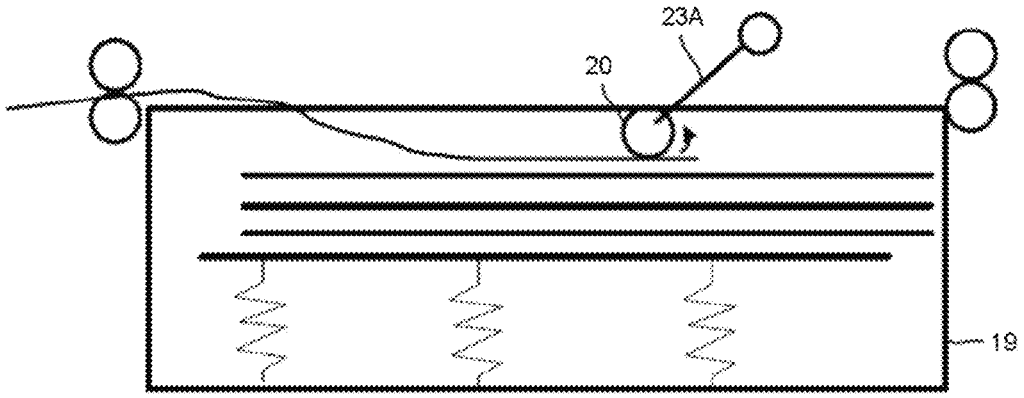
FIG. 10 is a diagram illustrating an alignment position.

FIG. 10 is a diagram illustrating the alignment position.

In the present embodiment, the alignment position of the combined roller 20 is a position where the downstream side of the sheet of which the downstream end is abutted against the wall portion 193 of the second cassette 19 is contacted with the combined roller 20. That is, the alignment position is set to be at the downstream side in the second cassette 19.

Figure 7:
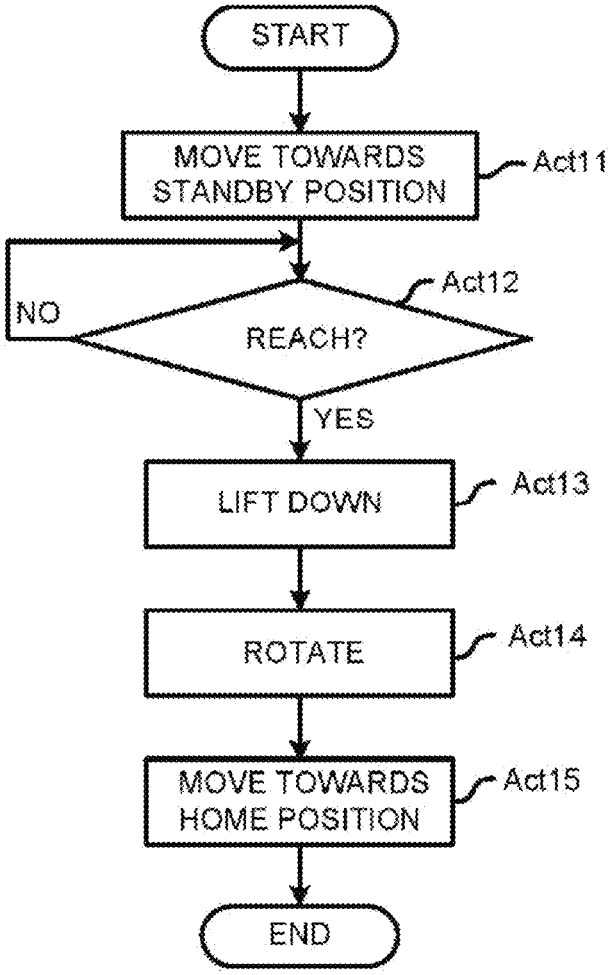
FIG. 7 is a flowchart illustrating the alignment processing at the time of the decoloring processing.

In the processing in ACT 13 in FIG. 7, the processor 11 enables the moving mechanism 23A to lift down the combined roller 20 at the standby position to the alignment position, and in this way, the combined roller 20 presses against the downstream side of the sheet.

The processor 11 sets the sheet feeding amount by the combined roller 20 at the time of the alignment processing to be slightly greater than the amount of sheet abutted against the wall portion 193. In the present embodiment, the bending amount of sheet when the sheet is abutted against the wall portion 193 during the alignment processing can be reduced, and a returning amount to the upstream side of sheet after the sheet is abutted against the wall portion 193 can also be reduced. In this way, it is possible to obtain a good precision of alignment processing in the present embodiment.

In the present embodiment, since the alignment position of the combined roller 20 is a position where the downstream side of the sheet that is abutted against the wall portion 193 is contacted with the combined roller 20, the setting precision of the sheet feeding amount can be improved when compared to a case in which the alignment position of the combined roller 20 is a position where the upstream side of the sheet that is abutted against the wall portion 193 is contacted with the combined roller 20.

(A Fourth Embodiment)

Figure 11:
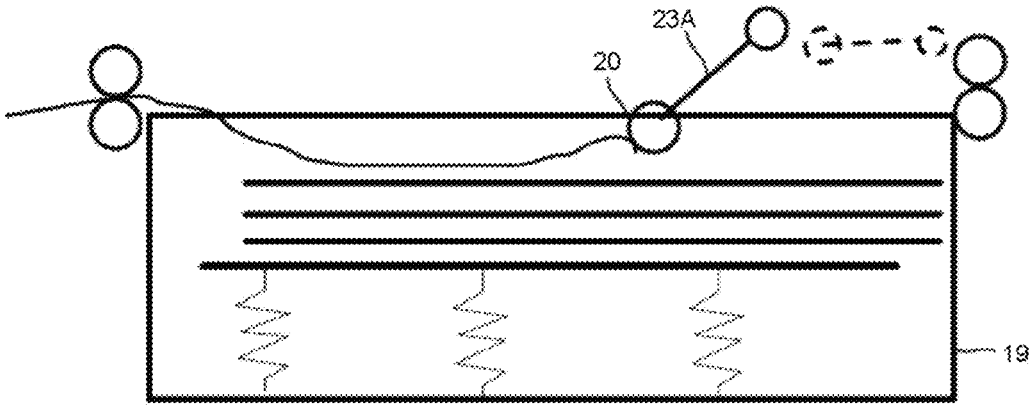
FIG. 11 is a diagram illustrating a standby position.

FIG. 11 is a diagram illustrating the standby position.

In the present embodiment, when the combined roller 20 is in a standby state (ACTS 11~12 in FIG. 7) until the combined roller 20 moves to and is positioned at the alignment position during the decoloring processing, a moving mechanism 23A positions the combined roller 20 to the standby position in FIG. 11 which corresponds to the alignment position and is located above the sheets that are stacked in the second cassette 19 and are not curled.

In the present embodiment, if a curl occurs at the downstream end of the discharged sheet, the curl abuts against the combined roller 20 and damages, and then the downstream end of the sheet reaches the lower part of the combined roller 20. Thus, it is possible to suppress the alignment failure and sheet feed failure very well.

(A Fifth Embodiment)

Figure 12:
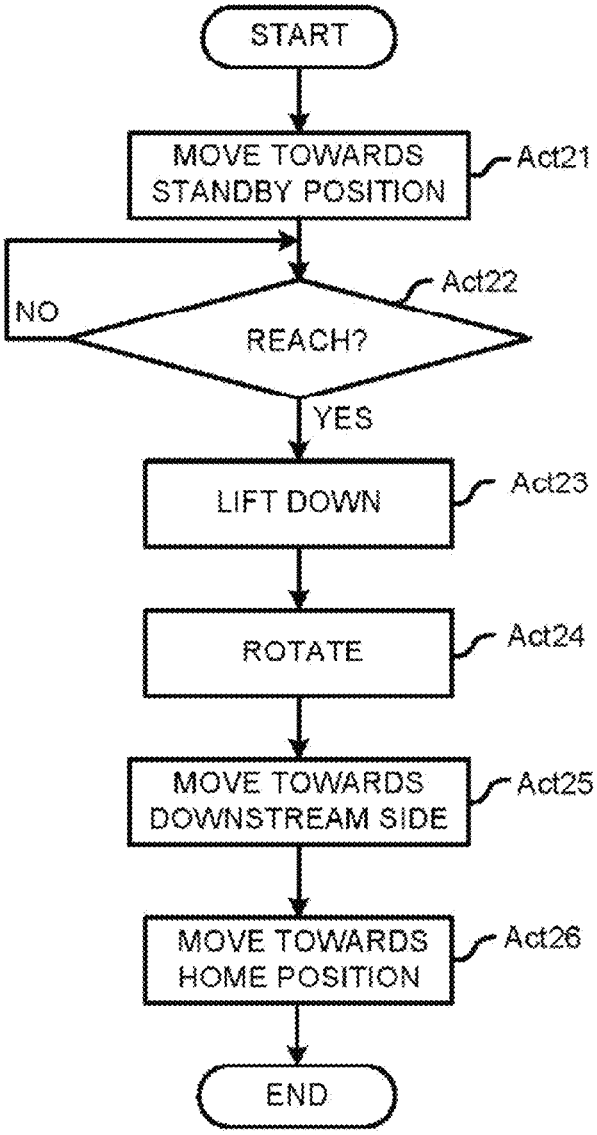
FIG. 12 is a flowchart illustrating the alignment processing at the time of the decoloring processing.

FIG. 12 is a flowchart illustrating an alignment processing at the time of a decoloring processing.

In the present embodiment, the processing in ACTs 21~24 in which the combined roller 20 is positioned at the alignment position to abut against the sheet and the combined roller 20 is also rotated simultaneously is the same as those in ACTs 11~14 in FIG. 7.

Figure 13:
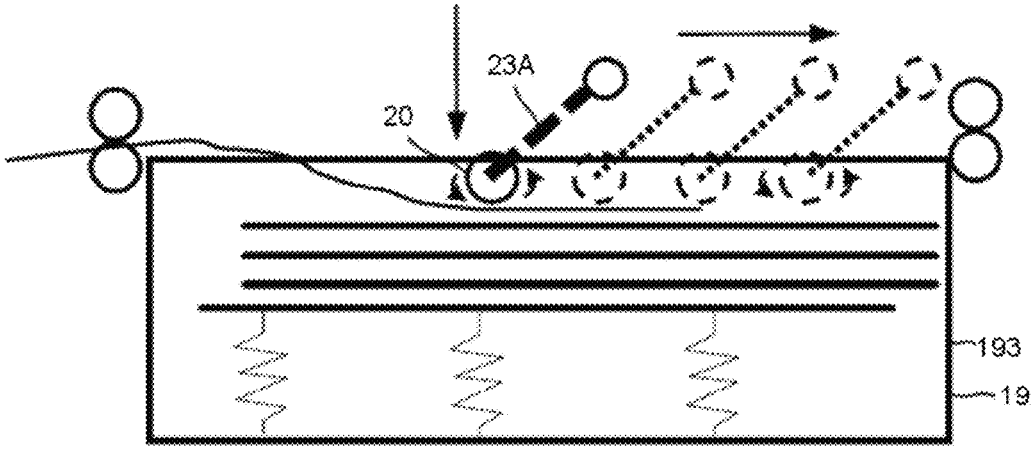
FIG. 13 is a diagram illustrating a sheet alignment method by the combined roller.

FIG. 13 is a diagram illustrating a sheet alignment method by the combined roller 20.

In ACT 25, the processor 11 enables the moving mechanism 23A to move the combined roller 20 which is being rotated at the alignment position to the downstream side along the conveyance direction. In this way, the processor 11 moves the sheet to the side of the wall portion 193 at the downstream end of the second cassette 19, and then the sheet is abutted against the wall portion 193 and aligned.

After the combined roller 20 is lifted up by the moving mechanism 23A under the control of the processor 11, the processor 11 positions the combined roller 20 at the home position (ACT 26).

Since the combined roller 20 sends the sheet to the downstream side while being moved to the downstream side in the present embodiment, the time taken to carry out a sheet alignment processing for one sheet can be shortened when compared to a case of sending the sheet to the downstream side while the combined roller 20 is stopped.

Further, it is exemplified in the embodiments described above that the image is decolored through the heat; however, the method of carrying out a decoloring processing on an image is not limited to decolor the image through the heat. For example, there may be a method of decoloring the image by coating solvent such as chemicals on the sheet-like image, or a method of decoloring the image by irradiating the image with light. Further, there may also be a method of decoloring an image by peeling off the image formed on a sheet physically.

As described above in detail, it is possible to provide a sheet alignment technology and a sheet pickup technology in accordance with the technologies disclosed in this specification.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet processing apparatus, comprising:

a decoloring section configured to carry out a decoloring processing on a sheet;

a stacking section to which the sheet subjected to the decoloring processing is discharged at a first position downstream from the decoloring section;

an image forming section configured to carry out an image forming processing on the sheet fed from the stacking section at a second position downstream from the stacking section;

a paper feed roller configured to feed a sheet stacked in the stacking section to a conveyance path through which the sheet is fed to the image forming section;

a combined roller configured to align sheets to be discharged to the stacking section at a reference position in a conveyance direction in which the sheets are conveyed to the sheet feed roller, and feed the sheets stacked in the stacking section to the sheet feed roller along the conveyance direction; and a moving mechanism configured to move the combined roller along the conveyance direction to position the combined roller at an alignment position when aligning a sheet, and to position the combined roller at a sheet feed position that is different from the alignment position when feeding a sheet to the sheet feed roller.

2. The apparatus according to claim 1, wherein the moving mechanism changes the alignment position in the conveyance direction based on the size of sheet.

3. The apparatus according to claim 2, wherein the combined roller changes a feeding amount towards the conveyance direction of sheet to be discharged to the stacking section based on a sheet size.

4. The apparatus according to claim 1, wherein when the apparatus is in a standby state in which neither the decoloring processing nor the image forming processing is executed, the moving mechanism positions the combined roller at a home position which corresponds to the sheet feed position and is located above the sheet feed position.

5. The apparatus according to claim 1, wherein when the combined roller is in a standby state until the combined roller is moved to and positioned at the alignment position during the decoloring processing, the moving mechanism positions the combined roller at a standby position which corresponds to the alignment position and is separated from sheets stacked in the cassette.

6. The apparatus according to claim 1, wherein the moving mechanism lifts the combined roller down to contact with the sheet discharged to the cassette, and the initial contact position of the combined roller with the sheet is at the downstream side in the conveyance direction of sheet.

7. The apparatus according to claim 1, wherein the moving mechanism lifts the combined roller down to position at the alignment position and to enable the combined roller to contact with the sheet discharged to the cassette, and the initial contact position of the combined roller with the sheet is at the upstream side in the conveyance direction of sheet.

8. The apparatus according to claim 1, wherein after positioning the combined roller at the alignment position, the moving mechanism moves the rotating combined roller to the downstream side along the conveyance direction to align sheets at the reference position.

* * * * *